US005775505A

United States Patent [19]

Vasquez et al.

[11] Patent Number: 5,775,505

[45] Date of Patent: Jul. 7, 1998

[54] BLISTER CARD PACKAGE

[76] Inventors: William M. Vasquez, 4512 Saddle Run Rd., Elm City, N.C. 27822; Jeffrey Alan Murphy, 114 Westminster Dr., North Wales, Pa. 19454; Jill Nicole Sheldon, 1925 Chestnut Ridge Dr., Pittsburgh, Pa. 15205

[21] Appl. No.: 606,737

[22] Filed: Feb. 27, 1996

[51] Int. Cl.[6] ..... B65D 83/04

[52] U.S. Cl. ..... 206/538; 206/532; 206/807

[58] Field of Search ..... 206/532, 533, 206/534, 538, 539, 807, 820, 484.1, 484.2, 461, 469

[56] References Cited

U.S. PATENT DOCUMENTS

| | | |
|---|---|---|
| Re. 29,705 | 7/1978 | Compere . |
| 2,737,290 | 3/1956 | Volckening et al. . |
| 2,823,798 | 2/1958 | Volckening et al. . |
| 3,305,077 | 2/1967 | Greif et al. . |
| 3,380,578 | 4/1968 | Sparks . |
| 3,503,493 | 3/1970 | Nagy . |
| 3,630,346 | 12/1971 | Burnside . |
| 3,659,706 | 5/1972 | Serrell . |
| 3,721,336 | 3/1973 | Hannon . |
| 3,780,856 | 12/1973 | Braverman . |
| 3,809,220 | 5/1974 | Arcudi . |
| 3,835,995 | 9/1974 | Haines . |
| 3,894,896 | 7/1975 | Watanabe . |
| 3,905,479 | 9/1975 | Gerner et al. . |
| 3,912,081 | 10/1975 | Haines et al. . |
| 3,912,082 | 10/1975 | Gerner et al. . |
| 3,921,805 | 11/1975 | Compere . |
| 3,924,746 | 12/1975 | Haines . |
| 3,924,747 | 12/1975 | Gerner . |
| 3,924,748 | 12/1975 | Braverman . |
| 3,933,245 | 1/1976 | Mullen . |
| 3,933,559 | 1/1976 | Watanabe . |
| 3,941,248 | 3/1976 | Moser et al. . |
| 4,011,949 | 3/1977 | Braber et al. . |
| 4,125,190 | 11/1978 | Davie, Jr. et al. . |
| 4,159,771 | 7/1979 | Komatsu et al. . |
| 4,189,053 | 2/1980 | Stagnitto et al. . |
| 4,211,329 | 7/1980 | Braverman . |
| 4,243,144 | 1/1981 | Margulies et al. . |
| 4,294,361 | 10/1981 | Margulies et al. . |
| 4,305,502 | 12/1981 | Gregory et al. . |
| 4,316,541 | 2/1982 | Braverman et al. . |
| 4,398,634 | 8/1983 | McClosky . |
| 4,398,635 | 8/1983 | Hirt . |
| 4,416,375 | 11/1983 | Braverman et al. . |
| 4,450,959 | 5/1984 | Sommer . |
| 4,506,789 | 3/1985 | Dlugosz . |
| 4,537,312 | 8/1985 | Intini . |
| 4,666,040 | 5/1987 | Murata . |
| 4,673,086 | 6/1987 | Braverman et al. . |
| 4,762,230 | 8/1988 | Croce . |
| 4,781,294 | 11/1988 | Croce . |
| 4,799,590 | 1/1989 | Furman . |
| 4,889,731 | 12/1989 | Williams, Jr. . |
| 4,911,304 | 3/1990 | Bunin . |
| 4,946,038 | 8/1990 | Eaton . |
| 4,988,004 | 1/1991 | Intini . |
| 5,014,851 | 5/1991 | Wick . |
| 5,046,618 | 9/1991 | Wood . |
| 5,088,603 | 2/1992 | Kirkpatrick . |
| 5,091,035 | 2/1992 | Anhäuser . |
| 5,163,559 | 11/1992 | Bunin . |

(List continued on next page.)

*Primary Examiner*—B. Dayoan
*Assistant Examiner*—Anthony Stashick
*Attorney, Agent, or Firm*—Connolly and Hutz

[57] ABSTRACT

An easy-opening blister card package is disclosed having a rigid container sheet with cavities formed in it and a closure sheet to seal the cavities. Between the cavities are finger tabs that are accessible by detaching individual sections of the blister card package. Once a section is detached, a finger tab is exposed which is pulled to form a larger pull tab. The pull tab is sufficiently large to allow the user to comfortably grasp it to peel apart the sealed layers. An alternate embodiment of the invention discloses a child-resistant blister card package wherein an additional seal must be broken to form the pull tab.

8 Claims, 2 Drawing Sheets

U.S. PATENT DOCUMENTS 5,172,812 12/1992 Wharton et al. .
5,310,060 5/1994 Bitner et al. .
5,325,968 7/1994 Sowden .
5,339,960 8/1994 Price .
5,358,118 10/1994 Thompson et al. .
5,393,032 2/1995 Cederroth .
5,538,129 7/1996 Chester et al. ..... 206/469
5,609,246 3/1997 Borghorst et al. ..... 206/461

BLISTER CARD PACKAGE

FIELD OF THE INVENTION

The present invention relates to a blister card package for enclosing small solid forms of medication such as tablets, pills, capsules and the like.

BACKGROUND AND PRIOR ART

Blister card packages are commonly used to package pharmaceutical dosage forms to the consumer. They are substantially tamperproof, airtight, lightweight and economical to produce. Blister card packages also have a rigidity that protects the packaged item from damage during shipping and handling.

In conventional blister card packages individual dosages are separately stored, which effectively meters the correct dosage to a patient. For example, each dosage in a blister card package can be separated by perforations such that it can be readily detached. Blister card packages normally are constructed of several layers. Typically, the top sheet (or container sheet or container formstock), which is usually transparent, contains integrally-formed blisters or cavities designed to hold the blister contents. The top sheet is sealed to a closure sheet (or lidstock), which normally consists of a foil and paper laminate. In some blister card packages the pill is accessed by pressing it through the closure sheet, where the closure sheet is made of a rupturable material. In other cards, the closure sheet is peeled off from the transparent top sheet to release the blister contents.

A problem with many blister card packages is that they can be difficult to open. In a rupturable package, for example, the pill may crumble during opening. In a peel-apart package, the layers can be very difficult to separate because they are thin and are sealed tightly together. In some instances, it is desirable to provide a blister card package that is difficult for children, yet not unduly difficult for adults to open. There is always a need for blister card packages which can be economically produced, which provide the packaging and shipping advantages of blister card packaging yet allows easy opening.

Prior art blister card packages have provided unsealed areas between the container sheet and closure sheet which provide a finger hold to initiate manual separation of the sheets. For example, U.S. Pat. No. 3,921,805 discloses a blister pack wherein each detachable packet cell has an oblong unsealed area with a line of weakening down the middle. When the packet cell is bent along the line of weakening, a finger can be inserted into the unsealed area and the layers can be peeled apart.

U.S. Pat. No. 3,924,746 discloses a sheet of detachable child-resistant packages wherein each individual package is provided with a tab that must be detached from the package before the layers can be separated. The tab is sealed to the closure sheet along one edge and overlaps the closure sheet. Child-resistance is attributed to the necessity of following several steps in sequence to access the pill. Children have difficulty deciphering the steps whereas an adult, particularly with the aid of written instructions, can easily open the package.

SUMMARY OF THE INVENTION

The multi-section blister card package of the invention comprises a rigid container sheet with cavities for containing a product such as a pill and a closure sheet sealed to the container sheet and covering the cavities. The blister card package is detachable into individual sections, along lines of perforations, with each section containing at least one covered cavity around which the container sheet is sealed to the closure sheet. A small area of the closure sheet is exposed at the intersection of the lines of perforations where the container sheet has been cut away. When an individual section is detached, a portion of the area of exposed closure sheet is detached with it. This exposed area operates as a finger tab to allow the user to begin separating the container sheet and closure sheet.

Each detached package section has an unsealed area immediately bordering the exposed area of the closure sheet where the container sheet and closure sheet overlap but are not sealed together. The initial pull on the exposed area finger tab releases this overlapping unsealed area to create a pull tab sufficiently large to grasp comfortably between the thumb and forefinger and tear apart the layers to access the cavity contents.

In a different embodiment, the package passes child resistance tests when additional sealing is provided to make the peeling step more difficult. In particular, a sealed zone is added surrounding the area of exposed closure sheet. The sealed zone provides additional resistance during the initial peeling step where the user is pulling the exposed area finger tab. Thus, the child-resistant embodiment requires more dexterity and strength to open. Both embodiments require a sequential procedure of tearing the perforations, opening the finger tab to form the pull tab, and peeling the pull tab to release the pill. A child will have difficulty deciphering the correct sequence whereas an adult will be able to easily access the pill.

BRIEF DESCRIPTION OF THE DRAWINGS

The accompanying drawings illustrate certain currently preferred embodiments of the invention.

DESCRIPTION OF THE PREFERRED EMBODIMENTS

Figure 1:
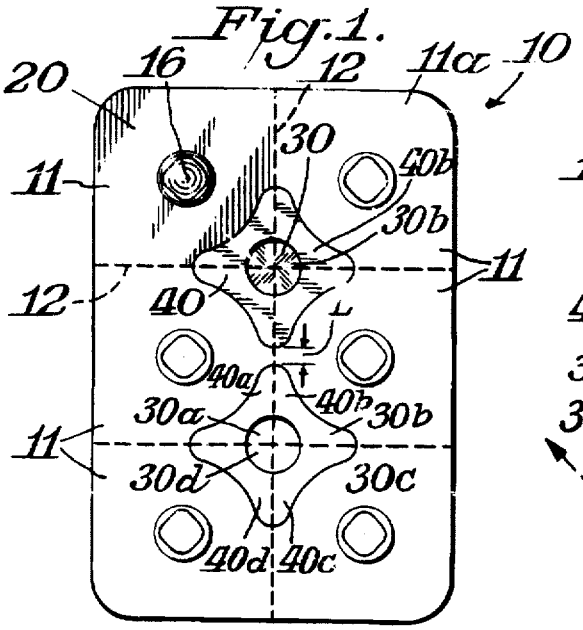
FIG. 1 is a top plan view illustrating a first embodiment of the invention having six individual sections arranged as one blister card package and which is not child-resistant.

Referring to the drawings, FIG. 1 shows a first embodiment of a blister card package in accordance with the present invention. The blister card package 10 is separated into six individual dosage sections 11. Each individual section is provided with a raised cavity 16 to accommodate a pill, medicament or the like stored therein. Each discrete section is detachable from the package due to perforations 12 running transversely in two directions and intersecting between the individual sections. Each section 11 may be detached from the blister card package 10 by bending and tearing along the lines of perforations, as is known in the art.

Figure 3:
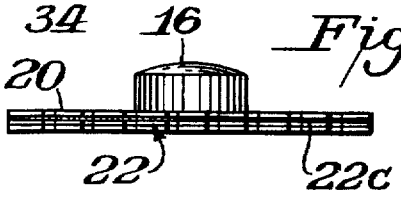
FIG. 3 is a side elevation view of the section of FIG. 2.
Figure 4:
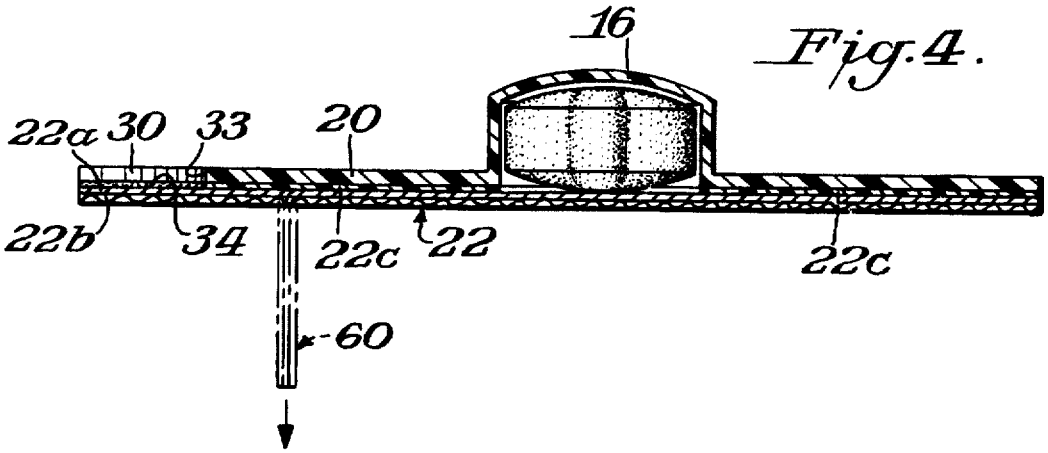
FIG. 4 is a cross-sectional view taken along line 4—4 in FIG. 2 showing the separation of the unsealed area to form the pull tab.
Figure 5:
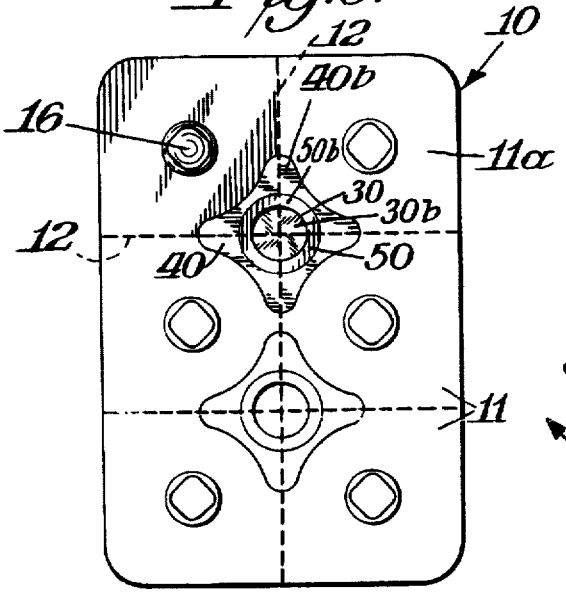
FIG. 5 is a top plan view illustrating a second embodiment which is child-resistant which also has six individual sections arranged as one blister card package.
Figure 6:
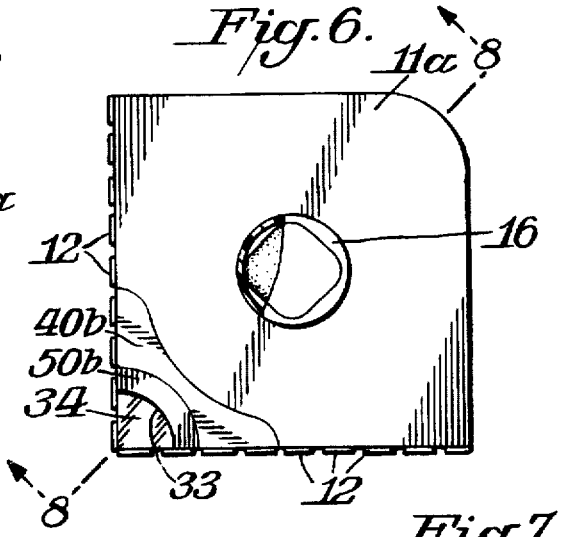
FIG. 6 is an enlarged top plan view of an individual section detached along the lines of perforation from the blister card package shown in FIG. 5.
Figure 7:
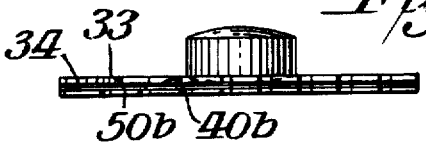
FIG. 7 is a side elevation view of the section of FIG. 6.

The blister card package 10 is multilayer and comprises a container sheet 20 and a closure sheet 22 as shown in FIGS. 3 and 4. Both layers and other layers optionally present are formed from conventional materials.

The container sheet 20 is preferably formed of a strong, rigid and transparent polymeric material, such as transparent polyvinyl chloride, polyvinyl dichloride, polyethylene or polypropylene. The container sheet has a substantial thickness of up to about 25 mils, more preferably about 10 mils, to provide the needed rigidity and protect the contents of the blisters. This provides a sufficiently rigid structure to prevent the product encased in the cavity from being crushed during shipping and also prevents child access to the product by biting or tearing through the container sheet. The cavities 16 are integrally formed in the container sheet, and may be of any desired size or configuration, depending on the dosage form to be stored.

The closure sheet 22 is preferably a laminate of thin metal foil, e.g. aluminum foil, shown at 22*a* and a paper layer shown at 22*b* (see FIG. 4) with the foil side of the laminate exposed to the medicament stored in the cavity and the paper side comprising the outer (bottom) layer of the assembled blister card package. The paper side of the closure sheet may serve as a label. Preferably, the label is provided on the back of the blister card such that a complete label is provided on the back (i.e. on the paper layer) of each section. The label may include the name of the medicament, the lot number, the expiration date, directions for opening the blister card package sections, or other identifying information.

The container sheet 20 and closure sheet 22 are sealed together substantially entirely from the outer edges of the card to the edges of the cavities. The sealing between layers is accomplished by conventional means such as heat sealing or adhesives, shown in exaggerated form as 22*c* in FIGS. 3 and 4.

Figure 2:
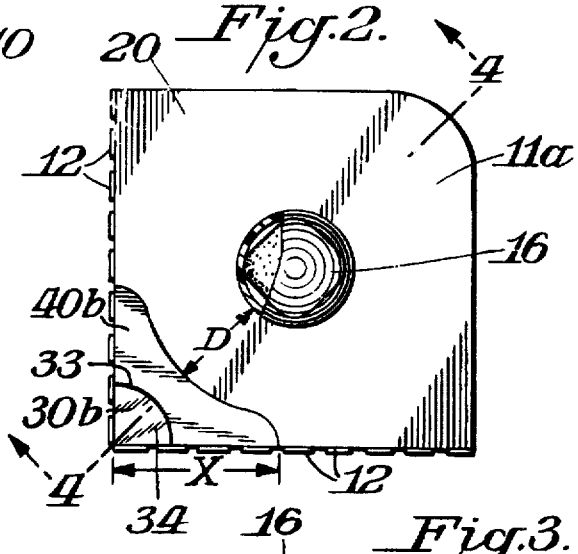
FIG. 2 is an enlarged top plan view of a single section which has been detached, along the lines of perforations, from the embodiment of the blister card package shown in FIG. 1.

As shown in FIG. 1, a circular cut out area 30 is provided in container sheet 20 which is divided by the perforation lines into quadrants 30*a*, 30*b*, 30*c* and 30*d*. As shown in FIG. 2, a detached section has one of the quadrants which is bordered by the curved edge 33 of the container sheet. This exposes a finger tab 34 which comprises the small exposed area of the underlying closure sheet which can be grasped with the fingers to separate the layers.

Further facilitating separation is the unsealed zone 40 (see FIG. 1) where the container sheet and closure sheet overlap but are not sealed together. In the preferred embodiment shown, the unsealed zone 40 is provided in a rounded diamond shape, with the points of the diamond on the lines of perforation generally rounded off, and the four sides of the diamond curved in a concave manner between the rounded points. In each detached section, this leaves an unsealed channel in each section as shown at 40*a*, 40*b*, 40*c* and 40*d* in FIG. 2.

In use, an individual dosage section 11 is detached from the blister card package 10 by bending and tearing along the perforations. When a section 11*a* is detached from the card, this exposes finger tab 34 (see FIG. 2) at a corner of the section. This allows a finger hold from which to begin peeling apart the closure sheet and container sheet. The initial pull separates the layers in the unsealed channel 40*b* which forms a larger pull tab 60 (see FIG. 4) which is pulled to access the pill in the cavity.

A second embodiment of the invention is illustrated in FIGS. 5–9. This embodiment is similar to the first embodiment described above but is made child-resistant by providing a ring seal 50 inside the unsealed area 40. When the sections are separated, ring seal 50 is divided into ring seal quadrants such as 50*b* (See FIG. 6).

The seal 50 provides added resistance to peeling and thereby prevents children from being able to peel apart the sheets and access the enclosed pill. This embodiment thus requires more dexterity and coordination to achieve opening.

Figure 8:
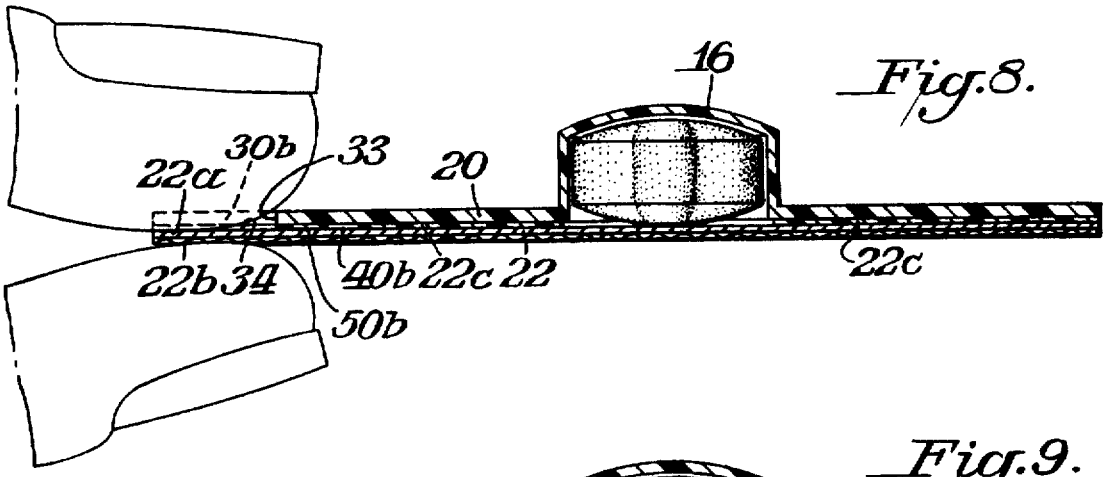
FIG. 8 is a cross-sectional view taken along the line 8—8 in FIG. 6 with the finger tab being grasped.
Figure 9:
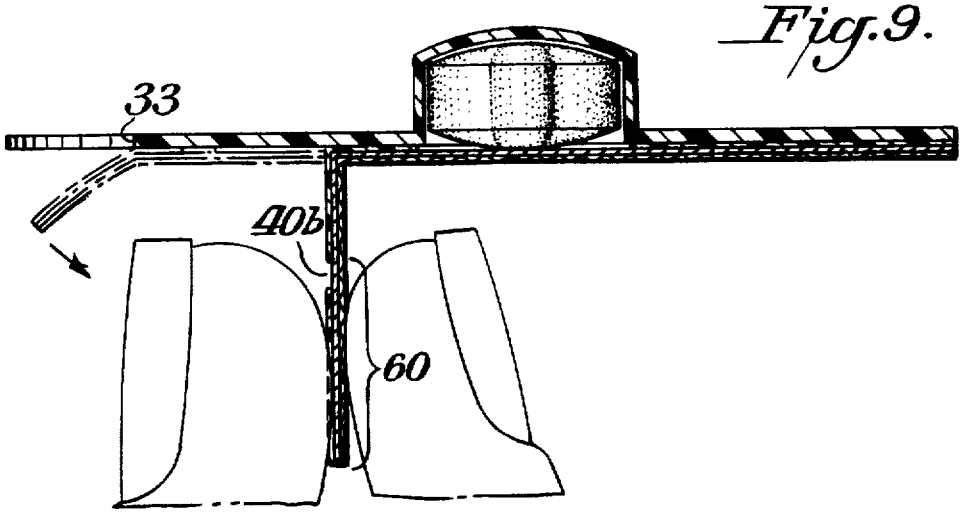
FIG. 9 is also a cross-sectional view along line 8—8 in FIG. 6, the finger tab having been pulled to form the larger pull tab.

In use of this embodiment, a section 11*a* is removed from the card and the finger tab 34 of the closure sheet is grasped as shown in FIG. 8. Pulling the finger tab as shown in FIG. 9 separates the quadrant 50*b* of the ring seal and thereafter, the sheets separate at the unsealed channel 40*b* thus forming the pull tab 60. The pull tab 60 can be comfortably grasped between the thumb and forefinger and the layers peeled apart to access the pill stored in the cavity 16 as shown in FIG. 9.

In the preferred embodiments described above, each blister card package has roughly square sections, with each section containing one dosage which is essentially centered in the section at a distance from the unsealed zone 40.

The shape of the unsealed channel 40*b* (FIG. 2) allows the unsealed area to extend a significant distance along the perforated sides (distance X in FIG. 2) while maintaining a substantial sealed distance (D in FIG. 2) between the unsealed area and the cavity, for security. From this design, the size of the pull tab is conveniently large while the integrity of the seal is maintained. It has been found that if the unsealed zone 40 is diamond-shaped as disclosed, two unsealed zones 40 may be separated along the length of the package on the perforation by a distance (L) shown in FIG. 1 which may be minimal, e.g. only about 1.5 mm, and the package remains secure.

The above preferred aspects are not limiting and the card can be varied in ways apparent to the skilled artisan reading the foregoing disclosure. For example, the size and shape of the card, the cavities that hold the product, sections of the card, and sealed and unsealed zones are subject to variation. Not every one of the detachable sections need contain a product cavity. The various layers may be modified or added to without departing from the invention as described.

We claim:

1. A multi-section blister card package comprising:

(a) a rigid container sheet having cavities formed therein for containing a dosage form and having at least one cut out area provided therein;

(b) a closure sheet sealed to the container sheet and covering the cavities in the container sheet;

(c) perforations allowing detachment of individual sections from the blister card package, wherein at least one of the individual sections contains at least one covered cavity around which the container sheet is sealed to the closure sheet, and wherein the perforations form intersections;

(d) at least one area of exposed closure sheet underlying the at least one cut out area of the container sheet, which area of exposed closure sheet is positioned at the intersections of the perforations; and (e) an unsealed zone surrounding said area of exposed closure sheet in which the container sheet and closure sheet overlap but are not sealed together;

whereby when the individual sections are detached, an area of exposed closure sheet forms a finger tab on the detached section which when pulled separates the container sheet and closure sheet in the unsealed zone to form a pull tab which can be pulled to access the product stored in the cavity.

2. A package as claimed in claim 1, wherein the blister card package comprises at least four sections.

3. A package as claimed in claim 1, wherein the unsealed zone is provided in the form of rounded diamond shape, with the center of the diamond situated at the intersection of the perforations.

4. A package as claimed in claim 3, wherein the area of exposed closure sheet is positioned in the center of the unsealed zone.

5. A package as claimed in claim 4, wherein the area of exposed closure sheet is surrounded by a ring seal between the exposed closure sheet and the unsealed zone.

6. A package as claimed in claim 1, wherein the container sheet is formed of transparent polyvinyl chloride.

7. A package as claimed in claim 1, wherein the closure sheet comprises a laminate of metal foil and paper.

8. A package as claimed in claim 1, wherein each of the individual sections contains a product cavity.

* * * * *